US009925469B2

(12) United States Patent
Rupp et al.

(10) Patent No.: US 9,925,469 B2
(45) Date of Patent: Mar. 27, 2018

(54) TILT AND DROP TRACK SWITCHING ELEMENT

(71) Applicant: Dynamic Structures, Ltd., Port Coquitlam (CA)

(72) Inventors: David Robert Rupp, Frederick, MD (US); Cynthia Lynn Emerick-Whitson, Camden, OH (US)

(73) Assignee: DYNAMIC STRUCTURES, LTD., Port Coquitlam, British Columbia (CA)

( * ) Notice: Subject to any disclaimer, the term of this patent is extended or adjusted under 35 U.S.C. 154(b) by 0 days.

(21) Appl. No.: 15/057,246

(22) Filed: Mar. 1, 2016

(65) Prior Publication Data

US 2016/0256786 A1 Sep. 8, 2016

Related U.S. Application Data

(60) Provisional application No. 62/127,865, filed on Mar. 4, 2015.

(51) Int. Cl.
*A63G 7/00* (2006.01)
*B61B 13/00* (2006.01)
(Continued)

(52) U.S. Cl.
CPC ..... *A63G 7/00* (2013.01); *A63G 21/14* (2013.01); *B61B 13/00* (2013.01); *E01B 7/00* (2013.01)

(58) Field of Classification Search
CPC ..... A63G 7/00; A63G 21/00; A63H 18/028; A63H 18/06
(Continued)

(56) References Cited

U.S. PATENT DOCUMENTS 845,967 A * 3/1907 Mosoovitz ..... A63G 21/00 104/164
862,607 A * 8/1907 Bragg ..... A63G 21/00 104/67
(Continued)

FOREIGN PATENT DOCUMENTS

DE 19615114 12/1997

OTHER PUBLICATIONS

International Search Report for PCT/CA2016/050212 dated May 6, 2016.
Written Opinion for PCT/CA2016/050212 dated Jun. 3, 2016.

*Primary Examiner* — Zachary L Kuhfuss
(74) *Attorney, Agent, or Firm* — Gottlieb, Rackman & Reisman, PC

(57) ABSTRACT

A track switching element for providing a ride experience in an amusement ride that includes a pivotable track section that has a longitudinally extending support beam with a longitudinally extending upper surface, a first end and a second end, the support beam includes a pivot element located between the first end and the second end, and a longitudinally extending rail that is adapted to receive a vehicle and that is located adjacent the upper surface. The rail communicates with an entry rail section when the pivotable track section is in a first position. A support structure cooperates with the pivot element such that the pivotable track section is pivotable about the pivot element from the first position to at least a second position such that the rail communicates with an exit rail section in the second position.

21 Claims, 8 Drawing Sheets

(51) Int. Cl.
*E01B 7/00* (2006.01)
*A63G 21/14* (2006.01)

(58) Field of Classification Search
USPC ..... 104/64, 79, 80
See application file for complete search history.

(56) References Cited

U.S. PATENT DOCUMENTS

| | | | | | |
|---|---|---|---|---|---|
| 1,075,397 | A | * | 10/1913 | Bouracier | B61B 1/02 104/164 |
| 1,097,615 | A | * | 5/1914 | D'Agostino | A63G 21/00 104/241 |
| 1,284,477 | A | * | 11/1918 | Seils | A63G 21/00 104/126 |
| 2,567,438 | A | * | 9/1951 | McBride | A63H 18/00 104/55 |
| 3,359,920 | A | * | 12/1967 | Iammatteo | A63H 18/028 104/160 |
| 4,185,409 | A | * | 1/1980 | Cheng | A63H 18/028 104/79 |
| 4,249,733 | A | * | 2/1981 | Eddins | A63H 18/08 104/79 |
| 6,941,872 | B2 | | 9/2005 | Roodenburg | |
| 7,484,460 | B2 | | 2/2009 | Blum | |
| 8,943,975 | B2 | | 2/2015 | Gmeinwieser | |
| 9,457,284 | B2 | * | 10/2016 | Ostendorff | A63H 18/00 |
| 2008/0009219 | A1 | * | 1/2008 | Nuttall | A63H 18/028 446/168 |

* cited by examiner

TILT AND DROP TRACK SWITCHING ELEMENT

CROSS-REFERENCE TO RELATED APPLICATIONS

This application claims the benefit and priority of U.S. Provisional Patent Application No. 62/127,865 filed on Mar. 4, 2015. The foregoing application is incorporated by reference herein in its entirety.

FIELD OF THE INVENTION

The present invention relates to track components for an amusement park ride. More specifically, the present invention relates to a tilt and drop track switching element.

BACKGROUND

Amusement rides are popular diversions around the world and provide a thrilling and otherwise unattainable entertainment experience in a safe, controlled manner.

Ride designers are constantly seeking novel ways in which to safely improve the ride experience and in this process have developed a wide variety of track designs and features that distinguish one ride from another, such as: hanging roller coasters, upside down loops, corkscrew loops, stand-up roller coasters, near vertical drops, backwards travel, among any other number of ride features that offer a thrilling experience in a safe manner.

Moreover, it is often desirable to switch a ride car from a first track to a second track for a variety of reasons. In some applications, it is desirable to switch the rail car from a first track to a second track in an exciting manner that adds to the entertainment experienced by a rider.

Accordingly, there is need for a track switching element that provides a safe yet thrilling and novel ride experience.

SUMMARY

In at least one embodiment, the present invention provides a tilt and drop track switching element that can switch an amusement ride car from a first track to a second track in a safe yet thrilling manner.

In at least one embodiment, the present invention provides a track switching element for an amusement ride, comprising a pivotable track section, the pivotable track section having a longitudinally extending support beam having a longitudinally extending upper surface, a first end and a second end, the support beam having pivot means located between the first end and the second end, and a longitudinally extending rail located adjacent the upper surface, the rail adapted to receive a vehicle and having a first rail end and a second rail end, one of the first rail end and the second rail end communicating with an entry rail section when the pivotable track section is in a first position; and a support structure for cooperating with the pivot means such that the pivotable track section is pivotable about the pivot means from the first position to at least a second position, one of the first rail end and the second rail end communicating with an exit rail section in the second position.

BRIEF DESCRIPTION OF THE FIGURES

The present invention will be better understood in connection with the following Figures, in which.

Figure 7:
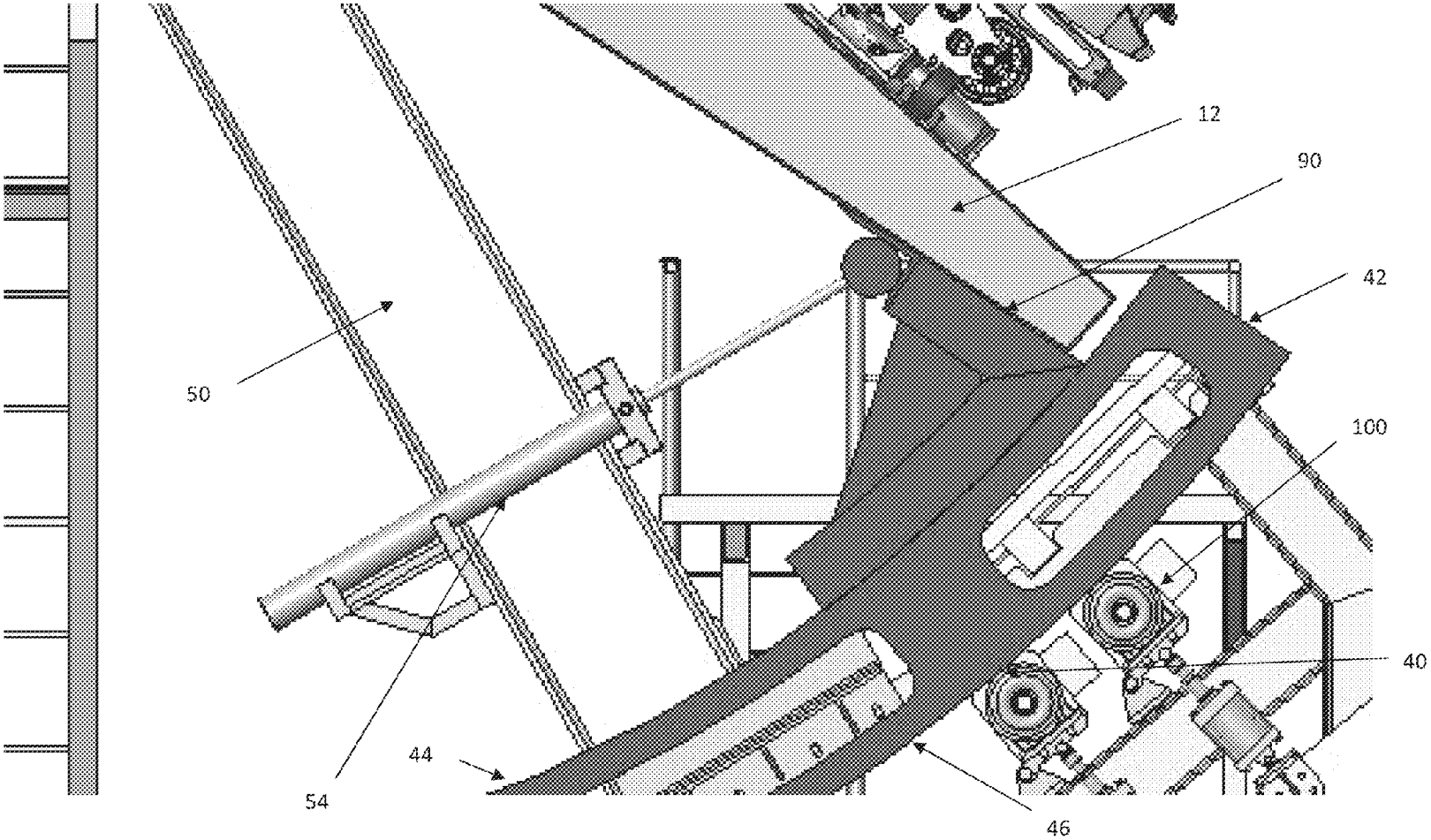
Figure 8:
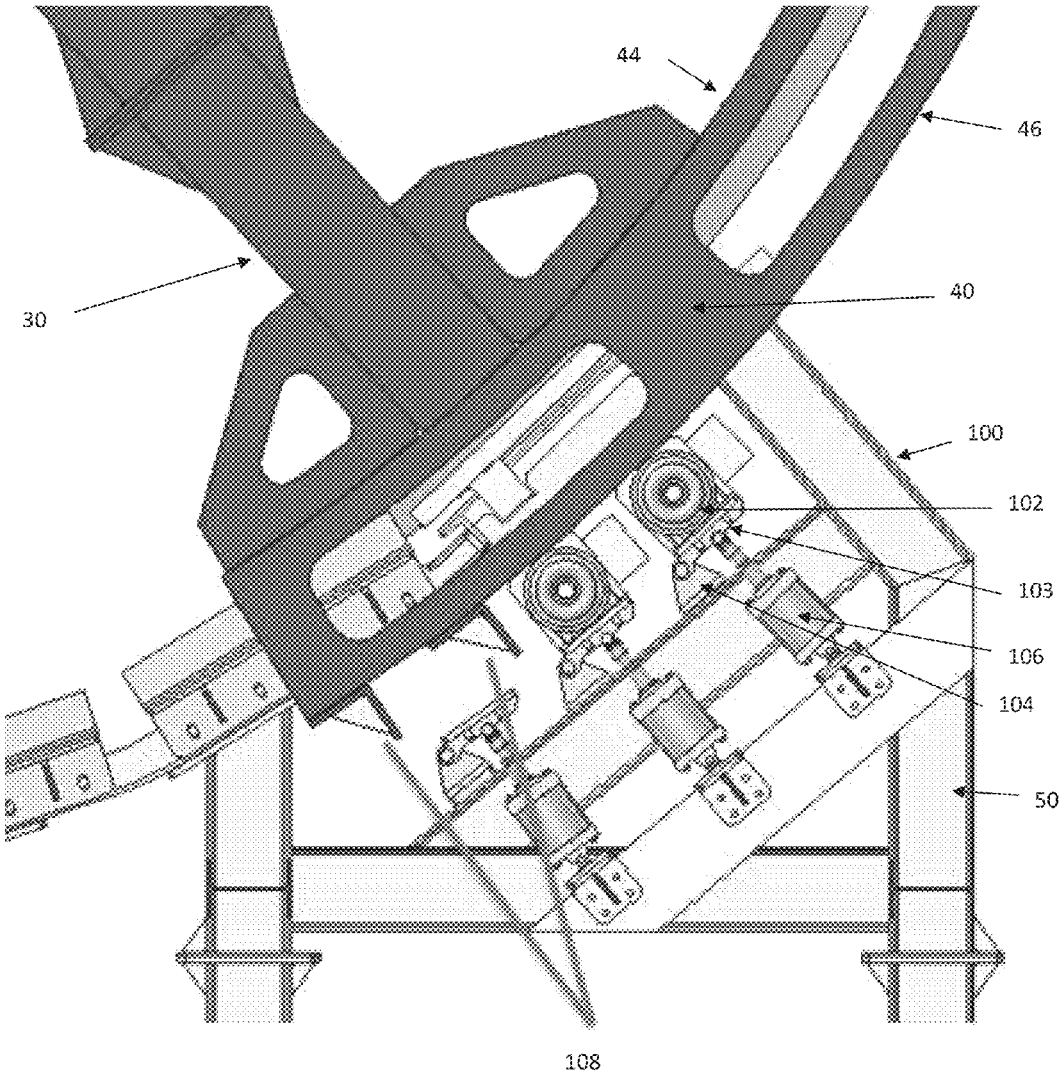

FIG. **6*a*** is a side view of a suspension system for a tilt and drop track switching apparatus in an engagement position in accordance with at least one embodiment of the present invention;

FIG. **6*b*** is a side view of a suspension system for a tilt and drop track switching apparatus in a limit position in accordance with at least one embodiment of the present invention;

FIG. 7 is a close up view of a suspension system for a tilt and drop track switching apparatus in an engagement position in accordance with at least one embodiment of the present invention; and FIG. 8 is a close up view of a friction drive system and a motion stop in accordance with at least one embodiment of the present invention.

DETAILED DESCRIPTION

In at least one embodiment, the present invention provides a tilt and drop track switching element that can provide a thrilling and novel ride experience in a safe manner.

It will be readily understood that all components discussed herein can be constructed of any suitable materials including but not limited to various structural steel alloys. Further, all components discussed herein can be manufactured by any suitable process that will be readily appreciated by the skilled person. Each component discussed herein can be formed from multiple sub-components suitably joined together or alternatively each component can be formed as a single unitary component.

In at least one embodiment, the present invention provides a tilt and drop track switching element that can offer a novel and thrilling ride experience and which has a pivotable track section that can pivot from a first position where the pivotable track section is engaged with a first entry track to at least a second position where the pivotable track structure is engaged with a second exit track. It is also contemplated that in some embodiments the pivotable track structure can pivot to an intermediary position where it does not engage with an entry or exit track.

It is contemplated that in some embodiments the entry track and exit track are the same track in other embodiments it is contemplated that the entry track is positioned within a first plane that is angularly disposed to a second plane and the exit track is disposed within this second plane.

The pivotable track structure has a first end, a second end and an upper surface. Pivot means are provided between the first end and the second end. At least one rail is provided adjacent the upper surface, and it is contemplated that the at least one rail can engage a rail car.

It is contemplated that either of the entry track and the exit track can connect to the rail component at either of the first end or the second end of the pivotable track structure.

A support structure is provided that engages with the pivot means in order to provide support for the pivotable track structure. It is contemplated that the support structure can take a wide variety of shapes and formats including but not limited to an A-frame structure as will be discussed in further detail below. In this way the pivotable track structure can pivot relative to the support structure from the first position to at least a second position.

The pivotable track structure has a first upper surface that has a rail component. In at least one embodiment the rail component has at least one rail that is adapted to receive a rail car. In some embodiments it is contemplated that the rail component is a first rail and a second rail. It is contemplated that the rails may be adjoined by cross ties, and further it is contemplated that the rails can be directly attached to the upper surface of the pivotable track structure while in other embodiments it is contemplated that the rails are attached to the upper surface of the pivotable track structure through an intermediary connecting component, such as a mounting bracket, Ringfeder™ coupler and/or the cross ties discussed above, among other arrangements that will be readily understood by the skilled person.

In some embodiments, the pivotable track structure has an outwardly convex drive arc and a downwardly projecting support column. The support column has a first end abutting a lower surface of the pivotable track structure and a second end. The drive arc has a first end that is connected to one of the first end and the second end of the pivotable track structure and an inner surface that is connected to the second end of the support column.

In some embodiments, the inner surface of the drive arc can have secondary braking means for braking the pivotable track structure relative to the support structure. In some embodiments it is contemplated that the outer surface of the drive arc can include at least one motion stop for arresting the motion of the pivotable track structure relative to the support structure.

The upper surface of the pivotable track structure can include a number of other systems, including but not limited to, braking means for braking the rail car, securing means for securing the rail car relative to the pivotable track structure and accelerating means for accelerating the rail car relative to the pivotable track structure.

The pivotable track structure in general can further include a number of other systems including locking means for locking the pivotable track structure in at least one of the first or second positions.

It is contemplated that the support structure can include a number of systems including, but not limited to, drive means that engage the outer surface of the drive arc for pivoting the pivotable track structure relative to the support structure, suspension means for providing shock absorption as the pivotable track structure approaches a limit position with respect to the support structure and winching means for pivoting the pivotable track structure with respect to the support structure in situations where the drive means are inoperable.

Turning to FIGS. 1, 2, 3 and 4 one embodiment of a tilt and drop track switching element is illustrated. Track switching element has a pivotable track section 10 has a support beam 12 having a first end 14, a second end 16 and an upper surface 18. At least one rail component 20 is located adjacent upper surface 18 and pivot means 22 are located at some position between first end 14 and second end 16. Further, deceleration means 24 can be located at a position adjacent upper surface 18 of pivotable track section 10. In at least one embodiment it is contemplated that pivot means 22 includes a horizontal and transversely extending axle that cooperates with a pair of radial load-bearing bearings, as can be seen in FIGS. 1 to 4.

Optional systems, such as but not limited to deceleration means, vehicular securing means and positional locking means can be located adjacent upper surface, as will be discussed in connection with FIG. 5 below. It is further contemplated that rail component 20 receives a vehicle 26 that is a rail car.

In some embodiments, pivotable track section 10 has a support column 30 that has a first end that abuts a lower surface of the support beam 12 and a second end. Pivotable track section can also have a drive arc 40 that has a first end 42 that is connected to the under surface of one end of support beam 12, an inner surface 44 and an outer surface 46.

Figure 1:
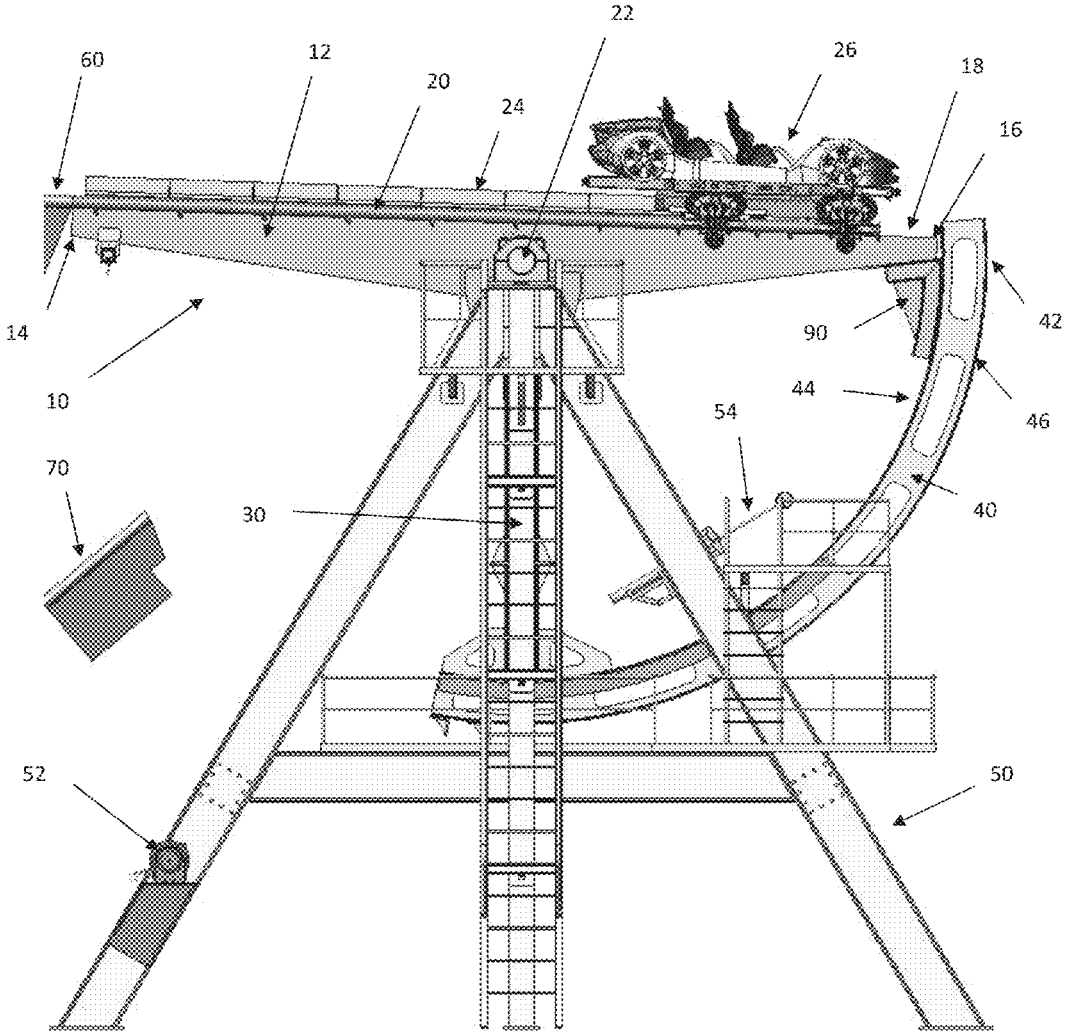
FIG. 1 is a side view of a tilt and drop track switching apparatus in a first position in accordance with at least one embodiment of the present invention.

In some embodiments it is contemplated that drive arc 40 is connected to one end of support beam 12 by way of engagement means 90, as will be discussed in further detail below. The second end of support column 30 can be connected to inner surface 44 of drive arc 40, as can be seen in FIGS. 1 to 3.

A support structure 50 is provided that can cooperate with pivot means 22. Support structure can be an A-frame structure as seen in FIGS. 1, 2, 3 and 4, among other arrangements that will be readily understood by the skilled person. Support structure can also include optional systems such as, but not limited to emergency winch means 52, 53 and over-travel shock absorption means 54, among other auxiliary systems which will be readily appreciated by the skilled person.

Figure 2:
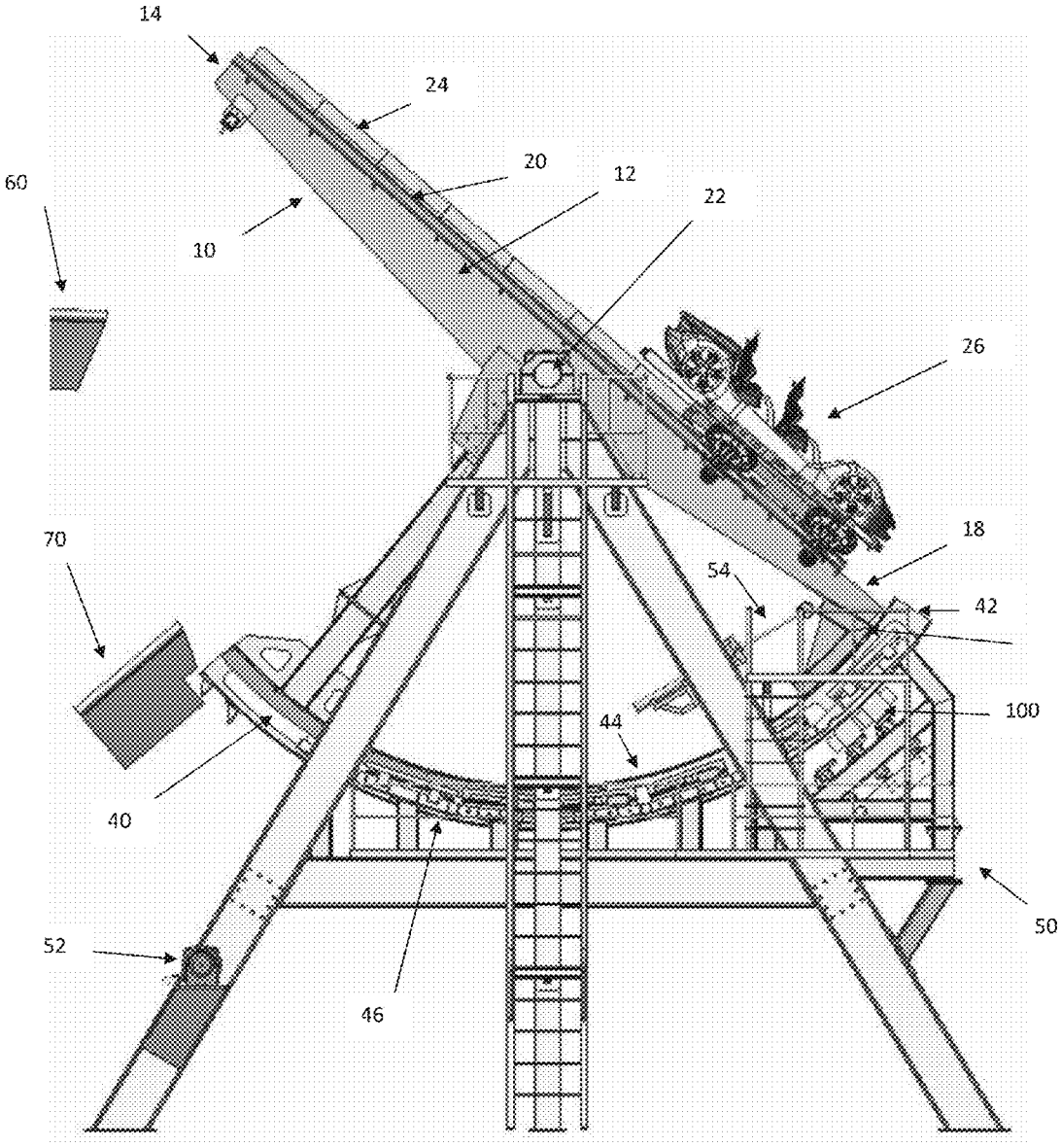
FIG. 2 is a side view of a tilt and drop track switching apparatus in an intermediate position in accordance with at least one embodiment of the present invention.
Figure 3:
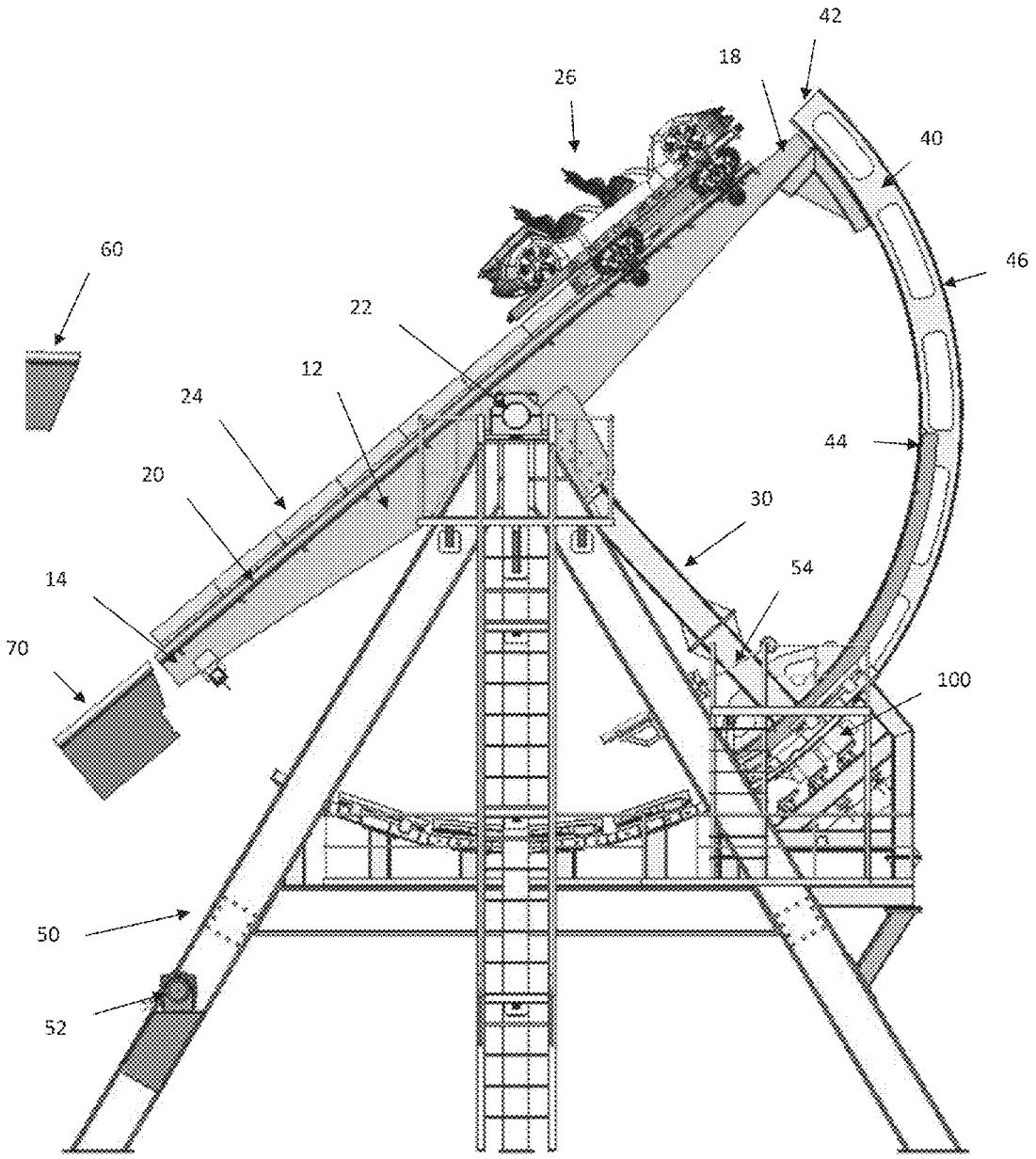
FIG. 3 is a side view of a tilt and drop track switching apparatus in a second position in accordance with at least one embodiment of the present invention.

In this way, pivotable track section 10 is pivotable about pivot means 22 such that it can pivot from a generally horizontal first position where it engages with an entry track section 60 (as seen in Figures land 4) to an intermediary and at least partially vertical position where it engages with no other track section (as seen in FIG. 2) to a second at least partially vertical position where it engages with an exit track section 70 (as seen in FIG. 3).

Figure 5:
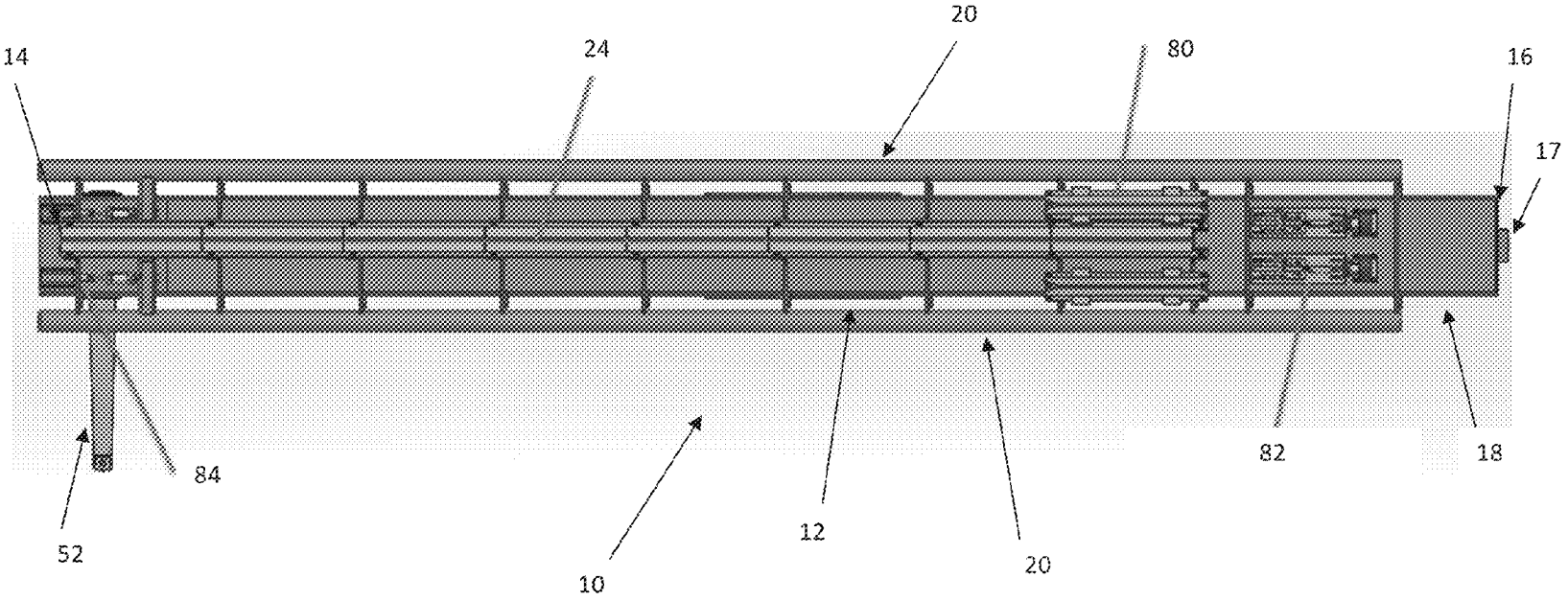
FIG. 5 is a top view of the upper surface of the pivotable track section in accordance tilt and drop track switching apparatus in a first position in accordance with at least one embodiment of the present invention.

Turning to FIG. 5 one embodiment of upper surface 18 of pivotable track structure 10 is illustrated. Pivotable track structure 10 has a support beam 12 having a first end 14, a second end 16 and an upper surface 18. At least one rail component 20 is located adjacent upper surface 18. Emergency winch means 53 may also be included in some embodiment as will be readily understood by the skilled person.

As can be seen in FIGS. 1 to 5, in some embodiments pivotable track structure 10 has two parallel rail components longitudinally extending adjacent to upper surface 18 of pivotable track structure 10. A projecting tongue 17 can be included at one of first end 14 and second end 16. It is contemplated that projecting tongue 17 can engage drive arc 40 in order to secure pivotable track section 10 relative to drive arc 40 as will be discussed in greater detail below.

Further, deceleration means 24 can be located at a position adjacent upper surface 18 of pivotable track section 10. It is contemplated that deceleration means 24 can be fastened to the upper surface 18 of pivotable track section 10 by any number of suitable means including welds and mechanical fasteners as will be readily understood by the skilled person.

In some embodiments, it is contemplated that deceleration means 24 can be a single fin linear synchronous motor ("LSM") stator module, among other arrangements that will be readily appreciated by the skilled person.

Optional systems, such as but not limited to braking means 80, vehicular securing means 82 and positional locking means 84 can be located adjacent upper surface 18. In some embodiments, positional locking means 84 can be interlock pins, among other arrangements that will be readily appreciated by the skilled person.

It is contemplated that rail component 20, deceleration means 24, braking means 80, vehicular securing means 82 and positional locking means 84 can take a wide variety of forms and can be secured to the upper surface 18 of pivotable track structure 10 by any number of suitable means including welds and mechanical fasteners as will be readily understood by the skilled person.

Figure 6B:
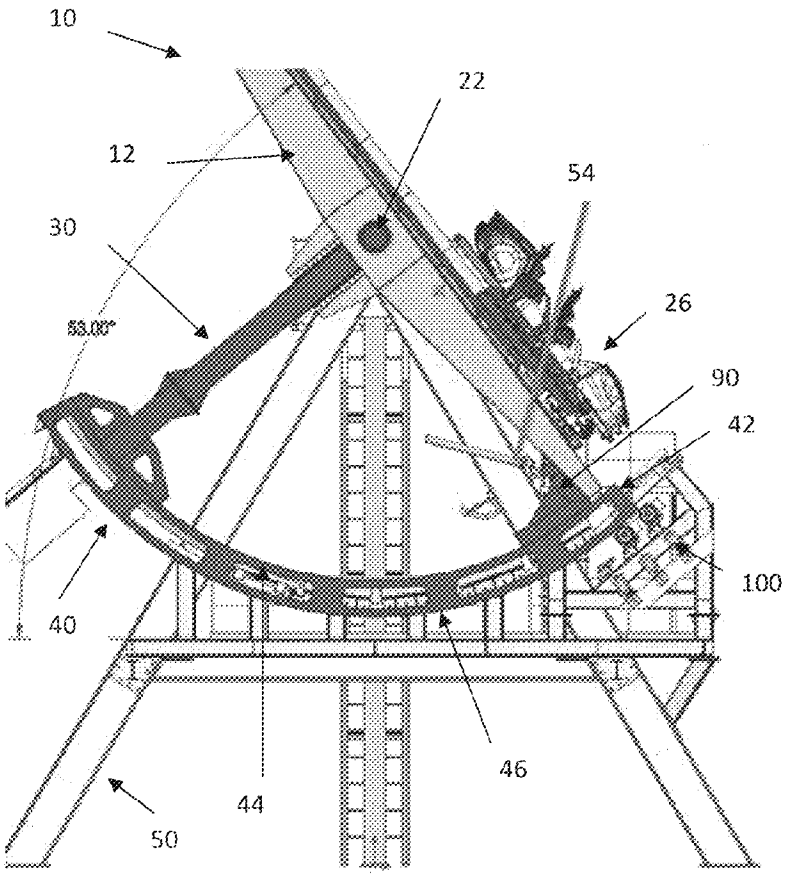
Figure 6A:
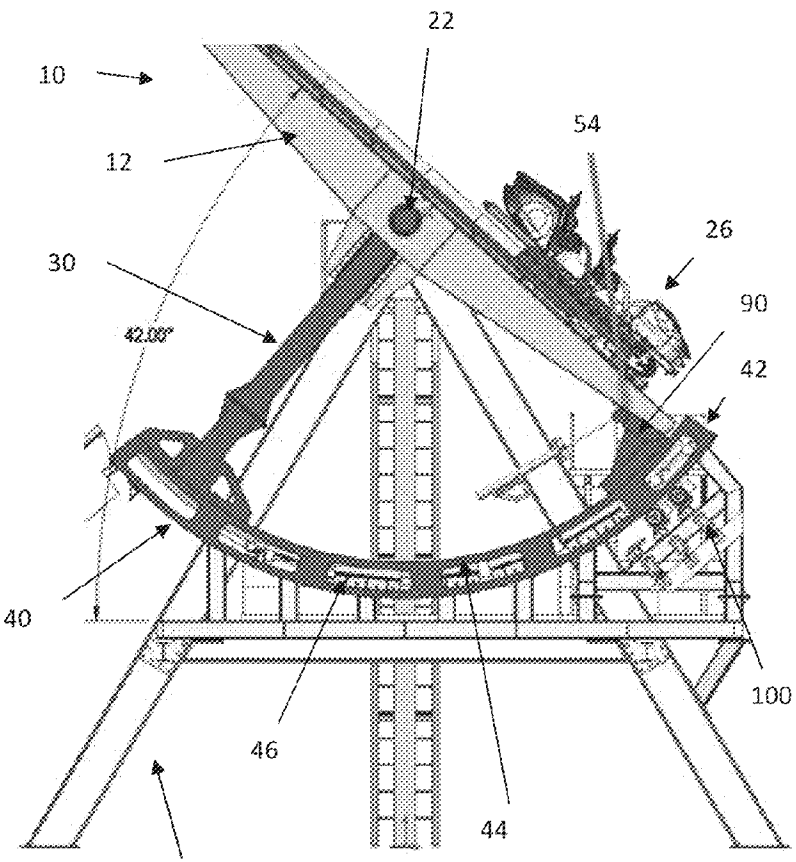

Turning to FIG. 6A and 6B, at least one embodiment of a pivotable structure 10, drive arc 40 and support structure 50 where the pivotable structure 10 is in a partially pivoted position (FIG. 6A) and a maximally pivoted position (FIG. 6B).

As can be seen in FIGS. 6A and 6B, in this embodiment pivotable track section 10 has a support column 30 that has a first end that abuts a lower surface of the support beam 12 and a second end. Pivotable track section 10 can also have a drive arc 40 that has a first end 42 that is connected to one end of support beam 12, an inner surface 44 and an outer surface 46. The second end of support column 30 can be connected to inner surface 44 of drive arc 40.

In this embodiment, engagement bracket 90 is located adjacent first end 42 of drive arc and at one end of support beam 12. Engagement bracket 90 is oriented such that it engages over-travel shock absorbing means 54 when pivotable track section 10 reaches a partially pivoted position, as can be seen in FIG. 6A. As pivotable track section 10 continues to pivot until a maximally pivoted position, over-travel shock absorbing means 54 approaches the limit of its shock absorbing travel and effectively halts any further travel of pivotable track section 10 relative to support structure as can be seen in FIG. 6B. It is also contemplated that in some embodiments engagement means 90 can also engage the underside or lower surface of support beam 12 of pivotable track structure 10 when pivotable track structure 10 is in a first, generally horizontal position as can be seen in FIG. 1.

Figure 4:
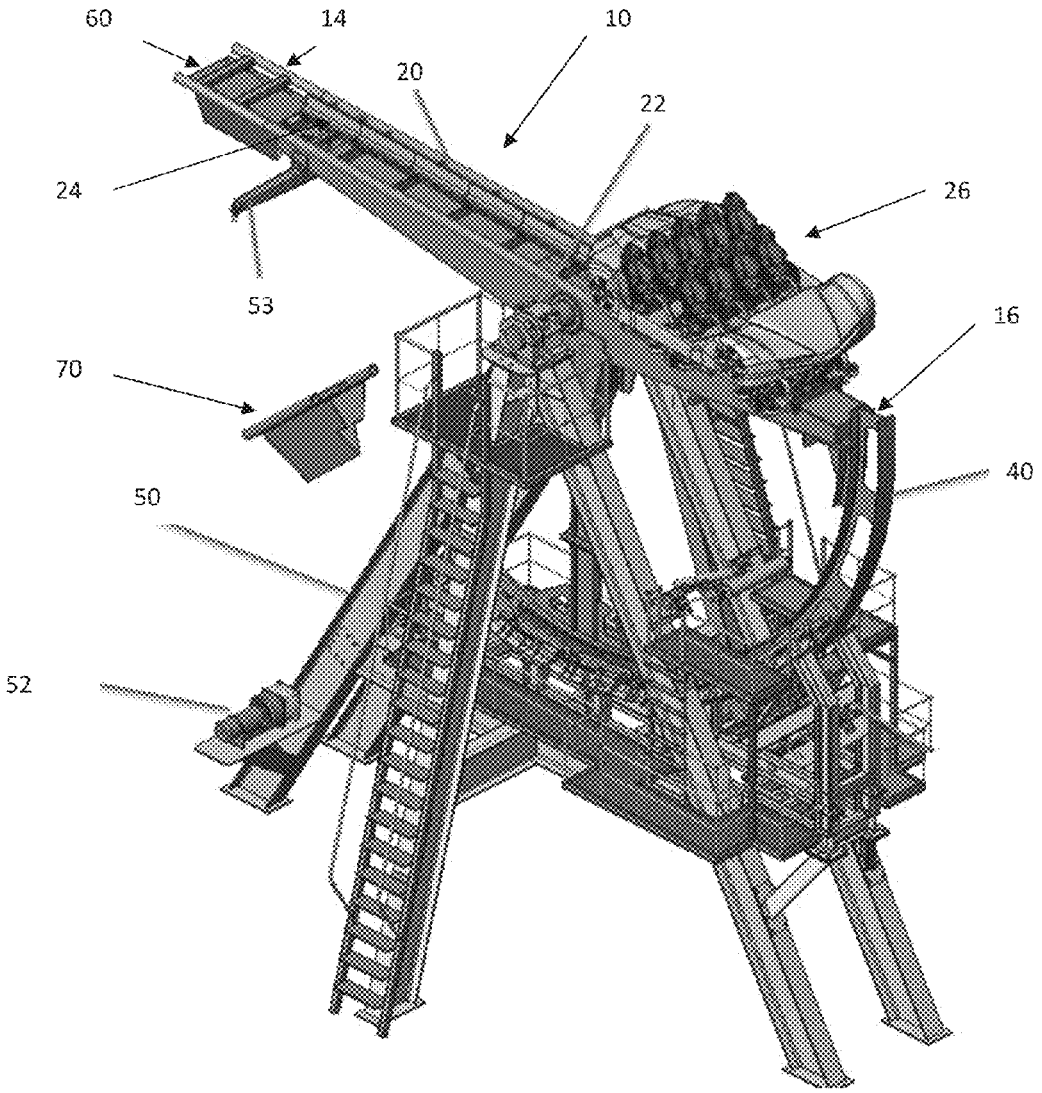
FIG. 4 is an isometric view of a tilt and drop track switching apparatus in a first position in accordance with at least one embodiment of the present invention.

Further, and as can be seen in FIGS. 2, 6A, 6B, 7, 8 in some embodiments arc drive means 100 can be provided that engage outer surface 46 of drive arc 40 in order to pivot pivotable track section 10 about pivot means 22 from a first, generally horizontal position (as seen in FIGS. 1 and 4) to at least a second, at least partially vertical position relative to support structure 50 (as seen in FIGS. 2 and 3).

As seen in FIG. 8, in at least one embodiment arc drive means 100 include a drive tire 102 rotably mounted to a pivoting plate 104 that is fixed to supporting structure 50 by way of a pivoting connection with mounting bracket 104. In some embodiments a pneumatic cylinder 106 can be provided in order to bias pivoting plate 104 and, by extension, drive tire 102 radially and inwardly into frictional contact with the outer surface 46 of drive arc 40.

Further, it is contemplated that pneumatic cylinder 106 is can be retracted in order to permit drive tire 102 to clear drive arc 40 for inspection or replacement as will be readily appreciated by the skilled person.

Further, in some embodiments a motion stop bracket 108 is provided on the outer surface 46 of drive arc 40. In this way, motion stop bracket 108 engages drive tire 102 in order to stop the movement of the drive arc 40 (and pivotable track section 10) relative to the support structure 50 once the drive arc 40/pivotable track section 10 reaches a maximal vertical position relative to the support structure.

It is also contemplated that in some embodiments a drive arc 40 can include an arc braking means (not shown) to slow and or stop the movement of the drive arc 40 (and pivotable track section 10) relative to the support structure 50.

In this way, pivotable track section 10 can be between at least a generally horizontal first position where it engage and communicates with first track section 60 (as seen in FIGS. 1 and 4) and an at least partially vertical second position where it engages and communicates with second track section 70. Therefore, vehicle 26 can be switched from first track section 60 and second track section 70.

Specifically, it is contemplated that vehicle 26 can travel from first track section 60 onto pivotable track section 10 where deceleration means 24 can decelerate vehicle 26 to a standstill whereby it can be secured in a locked position relative to pivotable track structure 10 with braking means 80 and/or vehicular securing means 82, as seen in FIG. 1.

In this first position, it will be readily appreciated that pivotable track section 10 is unbalanced given the presence of vehicle 26 at one end, and as such pivotable track section 10 only stays in this first position if positional locking means 84 are engaged to secure pivotable track section 10 relative to first track section 60.

Next, the positional locking means 84 can be disengaged to allow pivotable track section 10 and vehicle to pivot under the power of gravity to an at least partially vertical intermediary position, as seen in FIG. 2. Arc braking means can then be engaged to halt the movement of drive arc 40/pivotable track section 10 before over-travel shock absorption means 54 are engaged.

From this intermediary position, arc braking means can next be disengaged and arc drive means engaged to pivot drive arc 40/pivotable track section 10 about pivot means 22 to an at least partially vertical second position where one end of pivotable track section 10 engages and communicates with second track section 70, as seen in FIG. 3. At this point, it is further contemplated that positional locking means 84 can be engaged to secure pivotable track section 10 relative to second track section 70.

In this way, braking means 80 and/or vehicular securing means 82 can be disengaged to permit vehicle 26 to roll down pivotable track section 10 and onto second track section 70 where the ride can continue. In instances where there is an unexpected power interruption, winch means 52, 53 can be used to pivot pivotable track section 10 back to either the first position or second position in order to permit retrieval of vehicle 26.

It will be readily appreciated that although the pivot axis of pivot means 22 is transverse relative to pivotable track section 10 in the embodiments illustrated in FIGS. 1 to 7, it is also contemplated that the pivot axis of pivot means can be oriented in any number of manners such that pivotable track section 10 can pivot within a vertically oriented plane (as shown in FIGS. 1 to 7) or alternatively pivot means can have, for example, a generally vertically oriented pivot axis such that pivotable track section 10 can pivot within a generally horizontally oriented plane or any other suitable plane as will be readily understood by the skilled person.

It is obvious that the foregoing embodiments of the invention are examples and can be varied in many ways. Such present or future variations are not to be regarded as a departure from the spirit and scope of the invention, and all such modifications as would be obvious to one skilled in the art are intended to be included within the scope of the following claims.

We claim:

1. A track switching element for an amusement ride, comprising:

a pivotable track section, the pivotable track section having a longitudinally extending support beam having a longitudinally extending upper surface, a first end and a second end, the support beam having pivot means located between the first end and the second end, and a longitudinally extending rail located adjacent the upper surface, the rail adapted to receive a vehicle and having a first rail end and a second rail end, one of the first rail end and the second rail end communicating with an entry rail section when the pivotable track section is in a first position; and a support structure for cooperating with the pivot means;

wherein the pivotable track section is pivotable about the pivot means from a first position to at least a second position, one of the first rail end and the second rail end communicating with an exit rail section in the second position; and wherein the support beam further comprises a support column having a first end and a second end, a convexly projecting drive arc having a first end and an inner surface, the first end of the support column abutting a lower surface of the support beam, the first end of the drive arc abutting a lower surface of the support beam, the second end of the support column abutting an inner surface of the drive arc.

2. The track switching element of claim 1, having a longitudinally extending first rail and a longitudinally extending second rail.

3. The track switching element of claim 2, wherein the first rail is connected to the second rail by way of a laterally extending cross tie.

4. The track switching element of claim 1, wherein the entry rail section is oriented in a first plane and the exit rail section is located in a second plane, the first plane angularly disposed with respect to the second plane.

5. The track switching element of claim 1, wherein the support structure further comprises drive means for operably pivoting the pivotable track section about the pivot means.

6. The track switching element of claim 5, wherein the drive means is friction drive means, the friction drive means mounted to the support structure and adapted to engage an outer surface of the drive arc.

7. The track switching element of claim 6, wherein the outer surface of the drive arc further comprises a motion stop at a second end of the drive arc, the motion stop adapted to engage the friction drive means to prevent further movement of the pivotable track section relative to the support structure.

8. The track switching element of claim 7, wherein the outer surface of the drive arc further comprises braking means for braking the pivotable track section relative to the support structure.

9. The track switching element of claim 8, wherein the braking means are selected from the group consisting of: mechanical braking means and magnetic breaking means.

10. The track switching element of claim 1, wherein the support structure is an A-Frame structure.

11. The track switching element of claim 1, further comprising winching means linking the support structure to the support beam.

12. A track switching element for an amusement ride, comprising:

a pivotable track section, the pivotable track section having a longitudinally extending support beam having a longitudinally extending upper surface, a first end and a second end, the support beam having pivot means located between the first end and the second end, and a longitudinally extending rail located adjacent the upper surface, the rail adapted to receive a vehicle and having a first rail end and a second rail end, one of the first rail end and the second rail end communicating with an entry rail section when the pivotable track section is in a first position;

a longitudinally extending first rail and a longitudinally extending second rail, wherein the first rail is connected to the second rail by way of a laterally extending cross tie; and a support structure for cooperating with the pivot means;

wherein the pivotable track section is pivotable about the pivot means from a first position to at least a second position, one of the first rail end and the second rail end communicating with an exit rail section in the second position; and wherein the laterally extending cross tie is fixed to the upper surface of the pivotable track section by way of a connector.

13. The track switching element of claim 12, wherein the connector is selected from the group consisting of a ringfeder coupler and an L-bracket.

14. A track switching element for an amusement ride, comprising:

a pivotable track section, the pivotable track section having a longitudinally extending support beam having a longitudinally extending upper surface, a first end and a second end, the support beam having pivot means located between the first end and the second end, and a longitudinally extending rail located adjacent the upper surface, the rail adapted to receive a vehicle and having a first rail end and a second rail end, one of the first rail end and the second rail end communicating with an entry rail section when the pivotable track section is in a first position; and a support structure for cooperating with the pivot means;

wherein the pivotable track section is pivotable about the pivot means from a first position to at least a second position, one of the first rail end and the second rail end communicating with an exit rail section in the second position; an wherein the upper surface of the pivotable track section further comprises latching means adapted to secure the vehicle relative to the rail.

15. The track switching element of claim 14, wherein the upper surface of the pivotable track section further comprises braking means for arresting motion of the vehicle relative to the rail.

16. The track switching element of claim 15, wherein the braking means are selected from the group consisting of: mechanical braking means and magnetic breaking means.

17. The track switching element of claim 14, wherein the pivotable track section further comprises locking means for locking the pivotable track section in at least one of the first position and the second position.

18. The track switching element of claim 14, wherein the upper surface of the pivotable track section further comprises accelerating means for accelerating the vehicle relative to the rail.

19. A track switching element for an amusement ride, comprising:

a pivotable track section, the pivotable track section having a longitudinally extending support beam having a longitudinally extending upper surface, a first end and a second end, the support beam having pivot means located between the first end and the second end, and a longitudinally extending rail located adjacent the upper surface, the rail adapted to receive a vehicle and having a first rail end and a second rail end, one of the first rail end and the second rail end communicating with an entry rail section when the pivotable track section is in a first position; and a support structure for cooperating with the pivot means;

wherein the pivotable track section is pivotable about the pivot means from a first position to at least a second position, one of the first rail end and the second rail end communicating with an exit rail section in the second position; and wherein the support means further comprises a shock absorbing means, the support means adapted to engage the support beam as the support beam pivots to a limit position.

20. The track switching element of claim 19, wherein the shock absorbing means are a shock absorber pivotably mounted to the support structure, the shock absorber engaging the lower surface of the support beam when the support beam reaches the limit position.

21. The track switching element of claim 19, wherein the entry rail section is orientated in a first plane and the exit rail section is located in a second plane, the first plane angularly disposed with respect to the second plane.

* * * * *